US011608669B1

(12) United States Patent
Shanmugam et al.

(10) Patent No.: US 11,608,669 B1
(45) Date of Patent: Mar. 21, 2023

(54) DOOR OPERATOR HOUSING ASSEMBLY

(71) Applicant: Schlage Lock Company LLC, Carmel, IN (US)

(72) Inventors: Kanagaraj Shanmugam, Aruppukkottai Taluk (IN); Colins V. Jacob, Bangalore (IN); Christopher M. Salisbury, Ohio, IL (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

(21) Appl. No.: 17/492,108

(22) Filed: Oct. 1, 2021

(51) Int. Cl.
*E05F 1/08* (2006.01)
*E05F 3/22* (2006.01)
*E05F 1/10* (2006.01)

(52) U.S. Cl.
CPC ..... *E05F 3/227* (2013.01); *E05F 1/1041* (2013.01); *E05F 3/224* (2013.01); *E05Y 2900/132* (2013.01)

(58) Field of Classification Search
CPC . E05F 1/1025; E05F 1/04; E05F 1/105; E05F 1/1041; E05F 1/1008; E05F 3/10; E05F 3/12; E05F 3/104; E05F 3/102; E05F 3/22; E05F 3/221; E05F 3/223; E05F 3/224; E05F 3/227; E05Y 2201/212; E05Y 2201/25; E05Y 2201/256; E05Y 2201/618; E05Y 2201/716; E05Y 2201/722; E05Y 2201/11; E05Y 2201/474; E05Y 2201/492; E05Y 2900/132; E05Y 2400/818; E05Y 2201/41; E05Y 2600/45; E05Y 2600/46; Y10T 16/577; Y10T 16/2804; Y10T 16/285; Y10T 16/293; Y10T 16/585; Y10T 16/299; Y10T 16/286; Y10T 16/27
See application file for complete search history.

(56) References Cited

U.S. PATENT DOCUMENTS

| | | | | |
|---|---|---|---|---|
| 2,271,098 A | | 1/1942 | Schmidt | |
| 4,676,408 A | * | 6/1987 | Speitel | B65D 83/14 222/183 |
| 5,487,206 A | | 1/1996 | Brown et al. | |
| 5,946,772 A | * | 9/1999 | DeBower | E05F 3/00 16/84 |
| 6,125,505 A | * | 10/2000 | Jensen | E05F 3/227 16/DIG. 40 |
| 6,298,520 B1 | * | 10/2001 | Blickhahn | E05F 3/227 16/DIG. 40 |

(Continued)

FOREIGN PATENT DOCUMENTS

| | | | | |
|---|---|---|---|---|
| EP | 730077 A1 | * | 9/1996 | E05F 3/10 |
| EP | 2290184 A1 | | 3/2011 | |

*Primary Examiner* — Chuck Y Mah
(74) *Attorney, Agent, or Firm* — Taft Stettinius & Hollister LLP

(57) ABSTRACT

An exemplary housing assembly is configured for use with a door operator. The housing assembly generally includes a bracket configured for mounting to the door operator, a case configured to at least partially enclose the door operator, and an attachment mechanism configured to selectively couple the bracket with the case. In certain forms, the attachment mechanism includes a resilient clip arm formed on one of the bracket or the case, and a tang formed on the other of the bracket or the case. The resilient clip arm is configured to engage the tang to maintain engagement between the bracket and the case.

21 Claims, 5 Drawing Sheets

(56) References Cited

U.S. PATENT DOCUMENTS

| | | | | |
|---|---|---|---|---|
| 6,786,006 | B2 | 9/2004 | Kowalczyk et al. | |
| 7,774,899 | B2 | 8/2010 | Braunlich | |
| 10,385,601 | B2 | 8/2019 | McKibben et al. | |
| 10,626,654 | B2 | 4/2020 | Logan et al. | |
| 2021/0372190 | A1* | 12/2021 | Hellwig ..... | E05F 3/104 |

* cited by examiner

DOOR OPERATOR HOUSING ASSEMBLY

TECHNICAL FIELD

The present disclosure generally relates to housing assemblies, and more particularly but not exclusively relates to housing assemblies for door operators.

BACKGROUND

Door operators such as closers are commonly installed to doors in order to facilitate movement of the door between open and closed positions. For example, door closers are frequently utilized to bias doors toward a closed position. Because some consider the operators to be unsightly, a housing assembly is often installed about the operator to shield the operator from view, thereby increasing the aesthetic appeal of the overall assembly. Certain existing approaches utilize a bracket that secures to the closer body and a case that mounts to the bracket via a frictional fit. However, such assemblies have certain limitations, such as those related to the ability of the case to remain secured to the bracket. For these reasons among others, there remains a need for further improvements in this technological field.

SUMMARY

An exemplary housing assembly is configured for use with a door operator. The housing assembly generally includes a bracket configured for mounting to the door operator, a case configured to at least partially enclose the door operator, and an attachment mechanism configured to selectively couple the bracket with the case. In certain forms, the attachment mechanism includes a resilient clip arm formed on one of the bracket or the case, and a tang formed on the other of the bracket or the case. The resilient clip arm is configured to engage the tang to maintain engagement between the bracket and the case. Further embodiments, forms, features, and aspects of the present application shall become apparent from the description and figures provided herewith.

DETAILED DESCRIPTION OF ILLUSTRATIVE EMBODIMENTS

Figure 1:
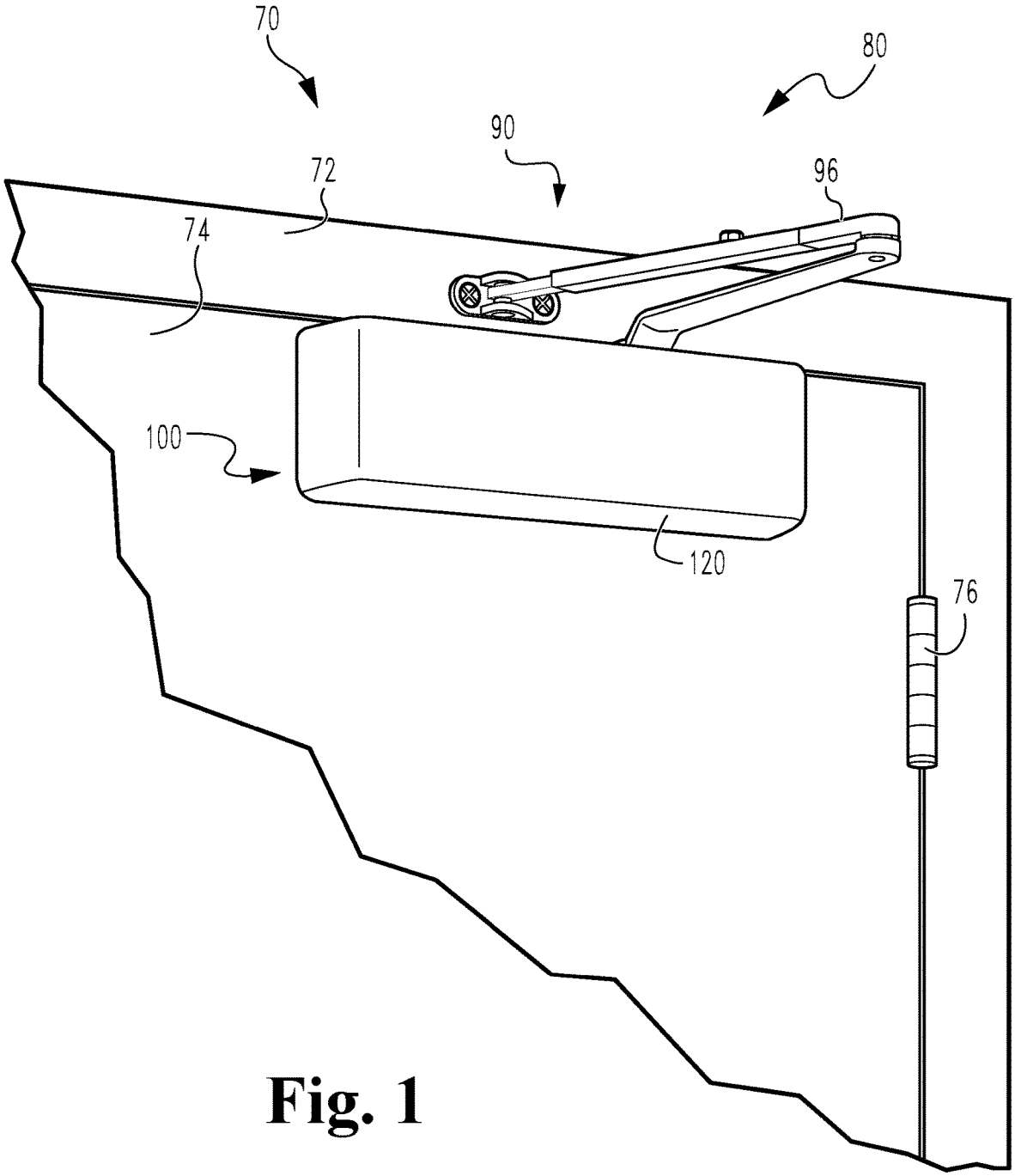
FIG. 1 is a perspective illustration of a closure assembly including a door operator assembly according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Items listed in the form of "A, B, and/or C" can also mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not necessarily be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may be omitted or may be combined with other features.

Figure 2:
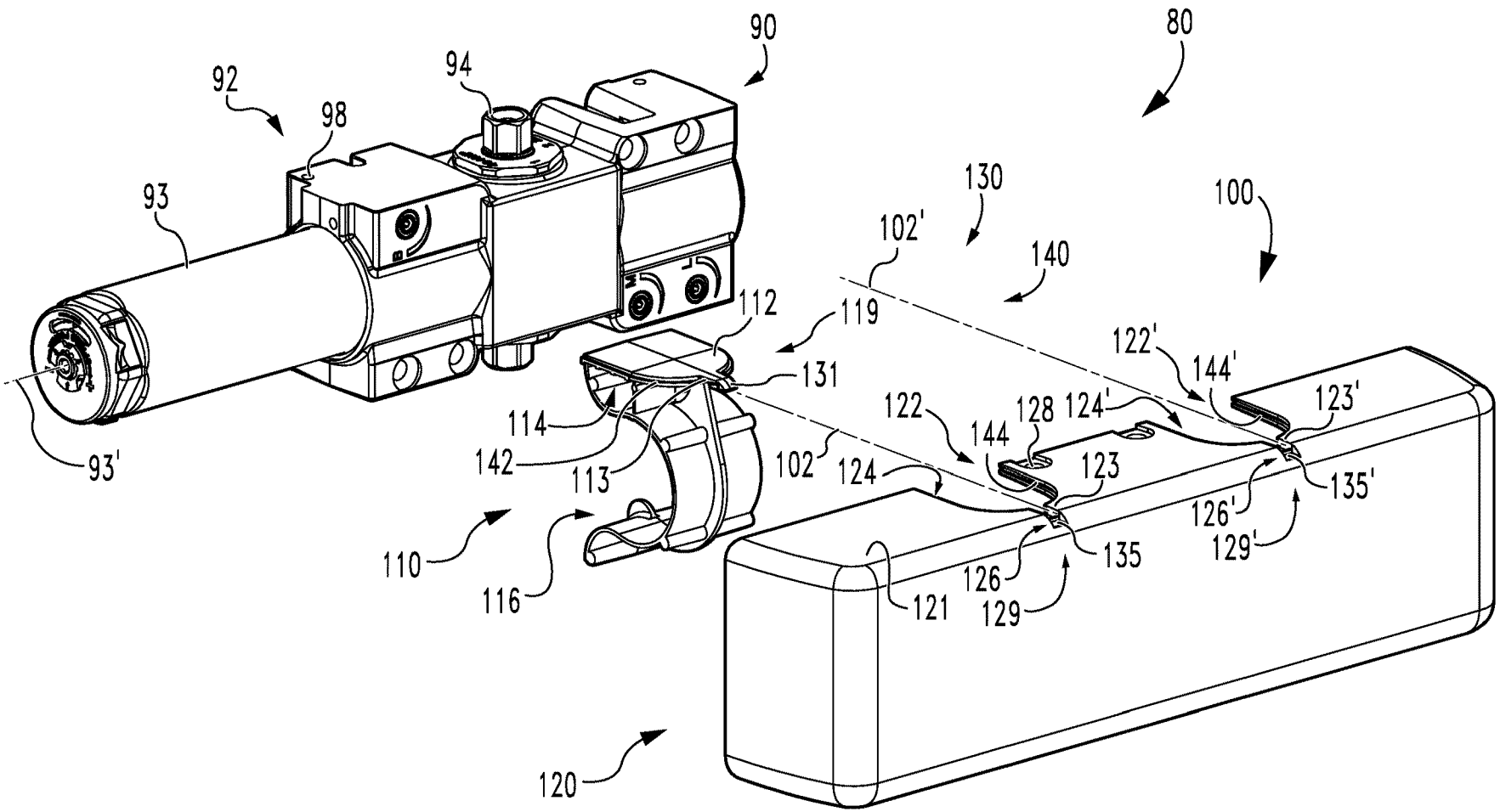
FIG. 2 is an exploded assembly view of the door operator assembly.

With reference to FIGS. 1 and 2, illustrated therein is a closure assembly 70 according to certain embodiments. The closure assembly 70 generally includes a doorframe 72, a door 74 pivotably mounted to the doorframe 72, and an operator assembly 80 according to certain embodiments. The door 74 is pivotably mounted to the doorframe 72 via one or more hinges 76, and is operable to swing between an open position and a closed position. The operator assembly 80 generally includes a door operator 90 and a housing assembly 100 according to certain embodiments. As described herein, the door operator 90 is configured to facilitate movement of the door 74 between the open position and the closed position, and the housing assembly 100 is configured to conceal at least a portion of the operator 90 from view.

Figure 3:
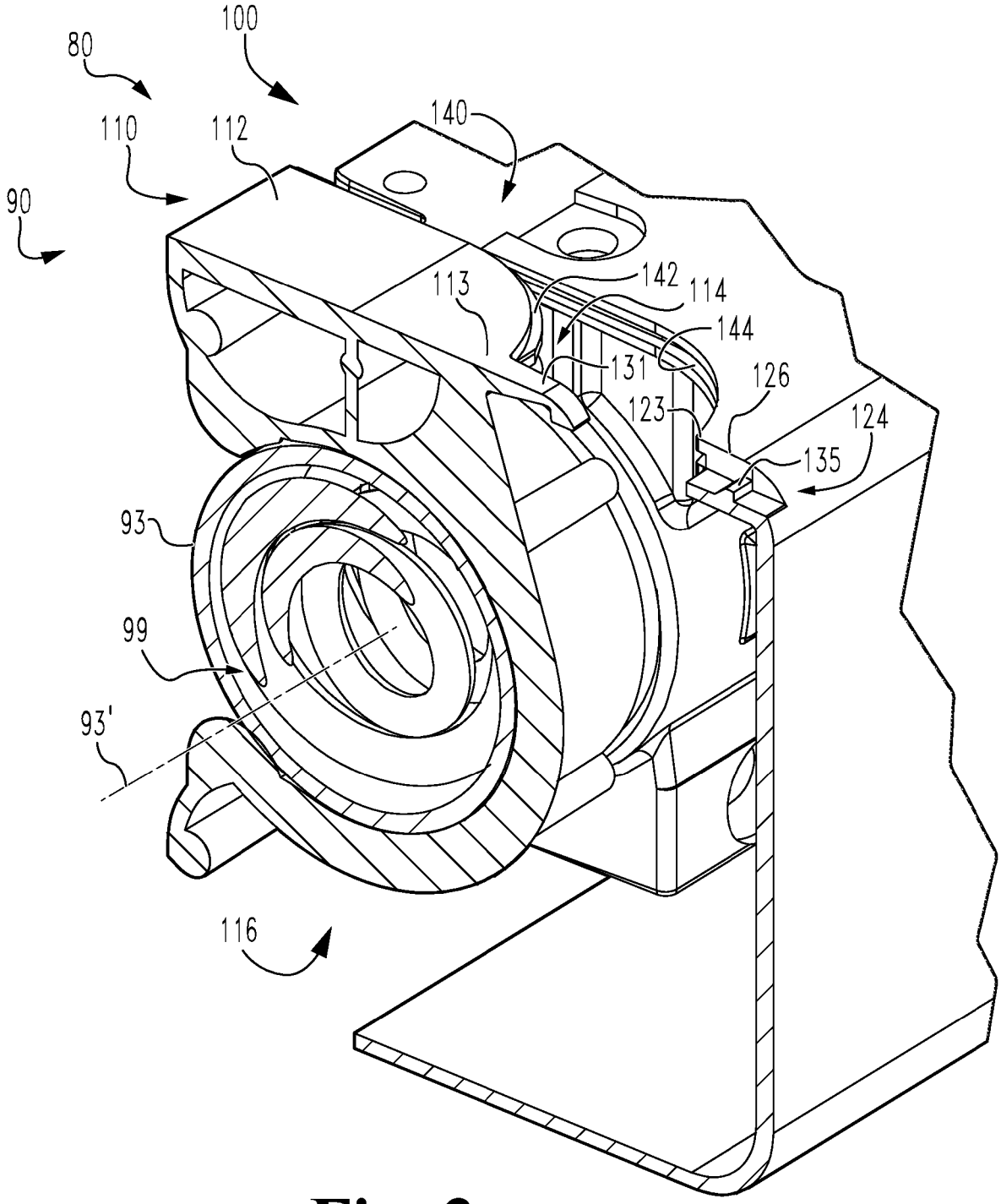
FIG. 3 is a perspective cutaway view of the door operator assembly in a partially-assembled state.

The door operator 90 generally includes a body 92, a pinion 94 rotatably mounted to the body 92, and an armature 96 connected with the pinion 94. In the illustrated form, the body 92 includes a tubular portion 93 that houses a spring 99 (FIG. 3). The spring 99 linearly biases a rack engaged with the pinion 94 in a door-closing direction, thereby rotationally biasing the pinion 94 in a corresponding closing direction. The body 92 is mounted to one of the doorframe 72 or the door 74, and the armature 96 is connected between the pinion 94 and the other of the doorframe 72 or the door 74 such that the door operator 90 biases the door 74 toward its closed position. As described herein, the body 92 may define one or more fastener openings 98 that facilitate the coupling of the body 92 with the case 120 via one or more fasteners.

In the illustrated form, the body 92 is mounted to the door 74, and the armature 96 is connected between the pinion 94 and the doorframe 72. In other embodiments, the body 92 may be mounted to the doorframe 72, and the armature 96 may be connected between the pinion 94 and the door 74. Additionally, while the illustrated armature 96 is provided in a "standard" configuration, in which the armature 96 extends away from the door 74 when the door 74 is in its closed position, it is also contemplated that the armature 96 may be provided in a "parallel arm" configuration, in which the armature 96 extends generally parallel to the door 74 when the door 74 is in its closed position. Furthermore, although the illustrated armature 96 includes two links that are pivotably coupled to one another at a joint 97, it is also contemplated that the armature 96 may include a single rigid arm including a first end that is coupled to the pinion 94 and an opposite second end that travels in a track. Moreover, while the illustrated operator 90 is provided in the form of a door closer configured to urge the door 74 toward its closed position, operators according to other embodiments may be additionally or alternatively operable to urge the door 74 toward its open position.

The housing assembly 100 generally includes a bracket 110 configured for coupling with the operator 90, a case 120 configured to at least partially enclose the operator 90, and an attachment mechanism 130 configured to selectively couple the bracket 110 with the case 120, and may further include a guide mechanism 140 configured to facilitate the coupling of the bracket 110 with the case 120. As described herein, the illustrated attachment mechanism 130 provides a positive coupling that may require a knowing act to decouple the case 120 from the bracket 110, thereby ensuring that the housing assembly 100 remains assembled in the absence of an intent to decouple the case 120 from the bracket 110.

The bracket 110 is configured for coupling with the operator 90, and in the illustrated form includes a base 112 and a generally C-shaped clip portion 116 extending from the base 112. While other geometries are contemplated, the illustrated base 112 is generally U-shaped relative to a sliding axis 102 of the housing assembly 100, and includes an apex 113 and an outer periphery 114. In the illustrated embodiment, the clip portion 116 is configured to receive the tubular portion 93 of the door operator 90. The bracket 110 may be formed of a resilient material such that the clip portion 116 is operable to elastically expand to receive the tubular portion 93, and to thereafter contract to maintain engagement between the bracket 110 and the tubular portion 93. As described in further detail below, the bracket 110 includes a first component 119 of the attachment mechanism 130.

While the illustrated bracket 110 is configured for mounting to the tubular portion 93 of the body 92, it is also contemplated that a bracket according to other embodiments may be configured for coupling with another portion of the operator body 92 and/or to couple with the body 92 in a manner other than clipping. As one example, the bracket 110 may be configured for coupling with the non-tubular portion of the illustrated body 92, or a non-tubular portion of another form of door operator body. As another example, the bracket 110 may instead include an annulus that slides onto the tubular portion 93.

The illustrated case 120 includes a plurality of sides, including an engagement side 121 that defines a recess 122 having an inner periphery 124. While other geometries are contemplated, the illustrated case 120 is generally in the form of a parallelepiped with an open rear side configured to receive the operator body 92 such that the case 120 is operable to at least partially enclose the operator 90. In the illustrated orientation, the engagement side 121 is a top side of the case 120. In other embodiments, the engagement side 121 may not necessarily be the top side of the case 120. For example, in embodiments in which the body 92 is mounted to the doorframe 72, the engagement side 121 may be the lower side of the case 120.

The recess 122 is configured to receive the base 112 of the bracket 110. In the illustrated form, the recess 122 is generally U-shaped along a corresponding sliding axis 102, and includes an apex 123 corresponding to the apex 113 of the base 112. In the illustrated form, the case 120 further includes a groove 126 extending from the apex 123 of the recess 122. As described herein, the illustrated case 120 further includes a second recess 122'. As also described herein, the illustrated case 120 also includes a second component 129 of the attachment mechanism 130 and a third component 129' of the attachment mechanism 130, and each of the second component 129 and the third component 129' is operable to engage the first component 119 to selectively couple the bracket 110 with the case 120. The case 120 may further include one or more fastener openings 128 corresponding to the fastener opening(s) 98 of the operator body 92.

Figure 4:
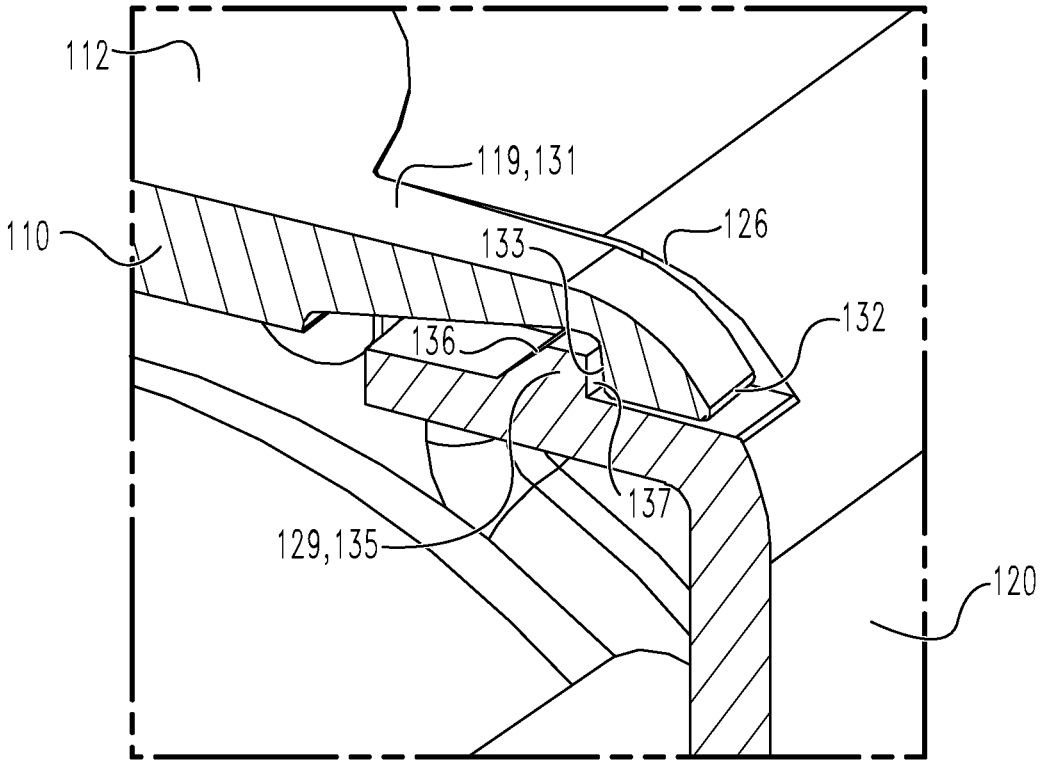
FIG. 4 is a perspective cutaway view of an attachment mechanism in a coupled state.

With additional reference to FIGS. 3 and 4, the attachment mechanism 130 aids in securing the case 120 to the bracket 110. As will become apparent from the description that follows, the attachment mechanism 130 is configured to selectively secure the case 120 to the bracket 110 in response to a pushing force urging the case 120 and the bracket 110 into engagement with one another, and to selectively prevent a pulling force opposite the pushing force from disengaging the case 120 from the bracket 110. The illustrated attachment mechanism 130 is provided in the form of a clip mechanism, and generally includes a clip arm 131 and a tang 135 operable to engage the clip arm 131. In the illustrated form, the clip arm 131 is configured to be received in the groove 126, and the tang 135 is formed within the groove 126. The clip arm 131 generally includes a nose 132 and a shoulder 133 facing in a direction opposite the nose 132. The tang 135 generally includes an oblique ramp 136 and a shoulder 137 facing in a direction opposite the ramp 136.

In the illustrated form, the clip arm 131 extends from the apex 113 of the bracket base 112, and the tang 135 is formed in a groove 126 that extends from the apex 123 of the case recess 122. It is also contemplated that this configuration may be reversed such that a clip arm is formed on the case 120 and a corresponding tang is formed on the bracket 110. For example, such a clip arm may extend from the apex 123 into the recess 122, and the corresponding tang may be formed in a groove in the base 112 that extends from the apex 113 along the corresponding sliding axis 102. Moreover, it is also contemplated that the groove 126 may be omitted, and that the tang 135 may be formed on an outer surface of the case 120 and/or the base 112 of the bracket 110.

As noted above, the bracket 110 includes a first component 119 of the attachment mechanism 130, and the case 120 includes a second component 129 of the attachment mechanism 130. In the illustrated form, the first component 119 comprises the resilient clip arm 131, and the second component 129 comprises the tang 135. As such, the third component 129' comprises a second tang 135' operable to engage the clip arm 131 of the bracket. In other embodiments, the first component 119 may comprise the tang 135, and the second component 129 may comprise the clip arm 131. In such forms, the third component 129' may comprise a second clip arm operable to engage the tang of the bracket 110.

The guide mechanism 140 facilitates insertion of the base 112 into the recess 122, and may further provide support that aids in retaining the coupling provided by the attachment mechanism 130. The guide mechanism 140 generally includes a ridge 142 formed along one of the outer periphery 114 of the base 112 or the inner periphery 124 of the recess 122, and a channel 144 formed along the other of the base outer periphery 114 or the recess inner periphery 124. In the illustrated form, the ridge 142 is formed along the outer periphery 114 of the base 112, and the channel 144 is formed along the inner periphery 124 of the recess 122. In other embodiments, the ridge 142 may be formed along the inner periphery 124 of the recess 122, and the channel 144 may be formed along the outer periphery 114 of the base 112.

During installation of the housing assembly 100 to the operator 90, the bracket 110 may be mounted to the body 92 of the operator 90. In the illustrated form, such mounting may involve engaging the clip portion 116 with the tubular portion 93, for example by sliding the clip portion 116 along the longitudinal axis 93' of the tubular portion 93, or by pressing the clip portion 116 into engagement with the tubular portion 93 in a direction transverse to the longitudinal axis 93'.

Either before or after mounting the bracket 110 to the closer body 92, the case 120 may be coupled with the bracket 110. In the illustrated form, such coupling may be guided by the guide mechanism 140. For example, coupling of the bracket 110 and the case 120 may involve inserting the ridge 142 into the channel 144 such that the guide mechanism 140 guides further relative sliding movement of the bracket 110 and the case 120 along the sliding axis 102.

With the base 112 partially received in the recess 122, the bracket 110 and the case 120 may be pushed toward one another in a first direction along the sliding axis 102. As the apexes 113, 123 approach one another, the clip arm 131 enters the groove 126 and the nose 132 of the clip arm 131 engages the ramp 136 of the tang 135, thereby elastically deforming the clip arm 131 from a home position to a deflected position. When the clip arm shoulder 133 clears the tang shoulder 137, the clip arm 131 returns to its home position such that the shoulders 133, 137 face one another. Should a user attempt to pull the bracket 110 and the case 120 apart (e.g., by exerting force in a second direction along the sliding axis 102), the abutting shoulders 133, 137 inhibit such separation until the user urges the clip arm 131 to its deflected position, at which point the shoulders 133, 137 can clear one another to permit separation of the bracket 110 and the case 120.

Figure 5:
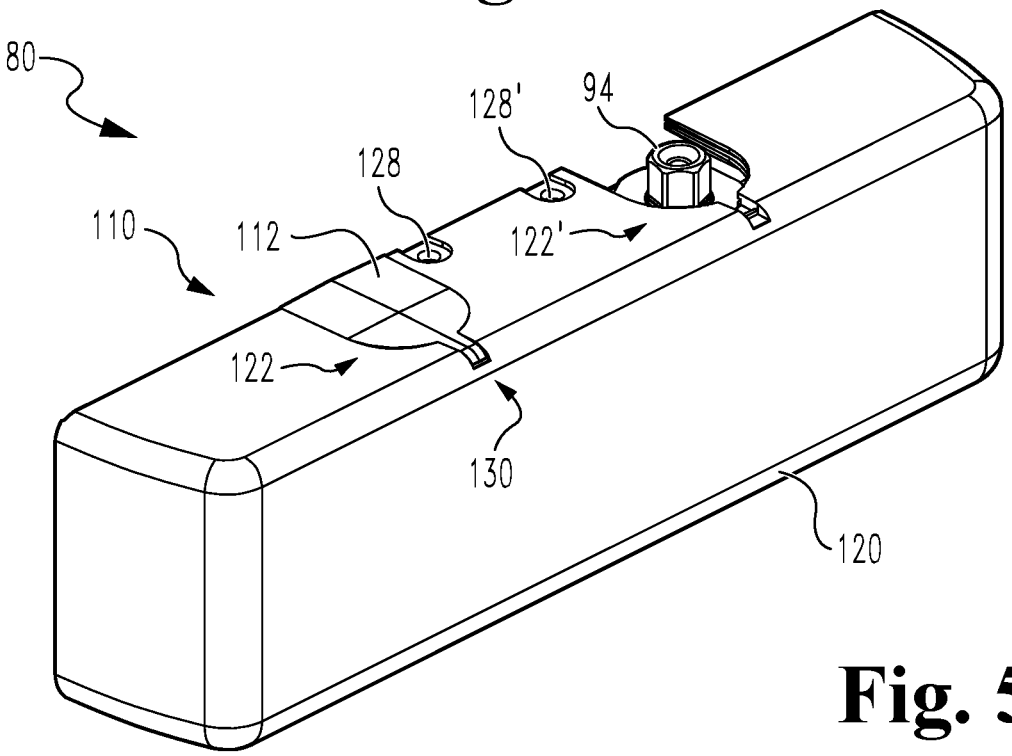
FIG. 5 is a perspective view of the door operator assembly in a more-assembled state.

With additional reference to FIG. 5, when the housing assembly 100 is installed to the door operator 90, the case 120 obscures the operator 90 from view. Additionally, with the base 112 received in the first recess 122, the pinion 94 extends through the second recess 122'. Thus, the second recess 122' may serve at least the function of permitting the pinion 94 to extend into engagement with the armature 96. In the illustrated form, the second recess 122' also serves the function of providing a second relative mounting position for the bracket 110 and the case 120, and is substantially similar to the first recess 122. The second recess 122' includes an apex 123' and an inner periphery 124' corresponding to the apex 123 and the inner periphery 124, and a groove 126' extends from the apex 123' in a manner analogous to that in which the groove 126 extends from the apex 123. As described herein, the two recesses 122, 122' may aid in installing the housing assembly 100 to different configurations of the operator 90, such as different handing orientations.

In the configuration illustrated in FIGS. 1-5, the operator 90 is positioned in a first handing orientation, in which the tubular portion 93 extends leftward from the remainder of the body portion 92, such that the pinion 94 is positioned to the right of the tubular portion 93 (when viewed from the region toward which the operator 90 faces when the door 74 is closed). In this configuration, the base 112 is received in the first recess 122, and the pinion 94 extends through the second recess 122' as described above. It is also contemplated that the operator 90 may be positioned in a second handing orientation, in which the tubular portion 93 extends rightward from the remainder of the body portion 92, such that the pinion 94 is positioned to the left of the tubular portion 93 (when viewed from the region toward which the operator 90 faces when the door 74 is closed).

When the operator 90 is positioned in the second handing orientation, installation of the case 120 to the bracket 110 may proceed along lines analogous to those described above with respect to the first handing orientation, with the exception that the relative movement of the bracket 110 and the case 120 will be along the second axis 102' such that the base 112 enters the second recess 122'. Those skilled in the art will readily appreciate that in such forms, the attachment mechanism first component 119 (e.g., the clip arm 131) will not engage the attachment mechanism second component 129 (e.g., the tang 135), but will instead engage the attachment mechanism third component 129' (e.g., the second tang 135'). As a result, the engagement of the first component 119 (e.g., the clip arm 131) with the third component (e.g., the second tang 135') will selectively prevent pulling forces along the second axis 102' from separating the case 120 from the bracket 110.

As should be evident from the foregoing, the attachment mechanism 130 is configured to selectively secure the case 120 to the bracket 110 in response to a pushing force urging the case 120 and the bracket 110 into engagement with one another. More particularly, the attachment mechanism second component 129 (e.g., the tang 135) is operable to engage the attachment mechanism first component 119 (e.g., the clip arm 131) in response to the first component 119 and the second component 129 being urged toward one another in a first direction (e.g., toward one another along the sliding axis 102). With the first component 119 and the second component 129 engaged with one another, the attachment mechanism 130 selectively prevents separation of the bracket 110 and the case 120 in a second direction opposite the first direction (e.g., away from one another along the sliding axis 102).

In the illustrated form, the attachment mechanism 130 further includes a third component 129' (e.g., the second tang 135') operable to engage the first component 119 (e.g., the clip arm 131) in response to the first component 119 and the third component 129' being urged toward one another in a third direction (e.g., toward one another along the second sliding axis 102'). With the first component 119 and the third component 129' engaged with one another, the attachment mechanism 130 selectively prevents separation of the bracket 110 and the case 120 in a fourth direction opposite the third direction (e.g., away from one another along the second sliding axis 102'). In the illustrated form, the sliding axes 102, 102' are parallel to one another such that the first direction and the third direction are parallel to one another, and the second direction and the fourth direction are parallel to one another. It is also contemplated that other relative orientations of the axes 102, 102' may be utilized. For example, the axes 102, 102' may be oblique to one another or perpendicular to one another.

Figure 6:
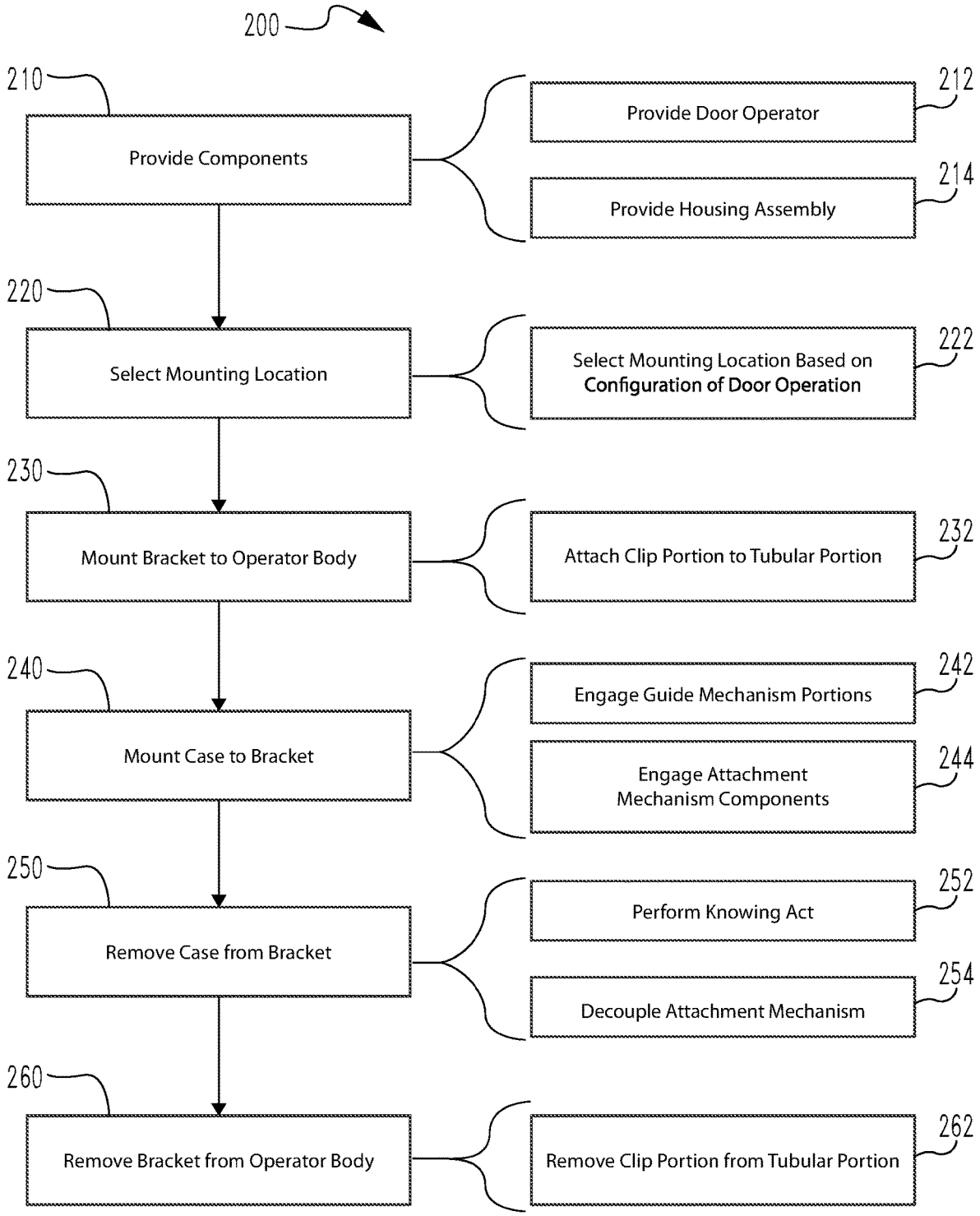
FIG. 6 is a schematic flow diagram of a process according to certain embodiments.

With additional reference to FIG. 6, an exemplary process 200 that may be performed using the closure assembly 70 is illustrated. Blocks illustrated for the processes in the present application are understood to be examples only, and blocks may be combined or divided, and added or removed, as well as re-ordered in whole or in part, unless explicitly stated to the contrary. Additionally, while the blocks are illustrated in a relatively serial fashion, it is to be understood that two or more of the blocks may be performed concurrently or in parallel with one another. Moreover, while the process 200 is described herein with specific reference to the closure assembly 70, the operator assembly 80, and the housing assembly 100 illustrated in FIGS. 1-5, it is to be appreciated that the process 200 may be performed with closure assemblies, operator assemblies, and/or housing assemblies having additional or alternative features.

In certain forms, the process 200 may involve a providing procedure 210, which generally involves providing one or more components of a closure assembly. The procedure 210 may involve block 212, which generally involves providing a door operator including a body and a pinion rotatably mounted to the body. For example, block 212 may involve providing the door operator 90, which generally includes a body 92 and a pinion 94 rotatably mounted to the body 92. In certain forms, the body may include a tubular portion, such as the tubular portion 93 of the illustrated body 92.

The procedure 210 may involve block 214, which generally involves providing a housing assembly configured for use with a door operator, such as the operator provided in block 212. For example, the block 214 may involve providing a housing assembly along the lines of the housing assembly 100. The housing assembly provided in block 214 may include a bracket configured for mounting to the body of the operator, a case configured to at least partially enclose the operator, and an attachment mechanism configured to selectively couple the bracket with the case. For example, block 214 may involve providing the housing assembly 100, which includes a bracket 110 configured for mounting to the body 92 of the operator 90, a case 120 configured to at least partially enclose the operator 90, and an attachment mechanism 130 configured to selectively couple the bracket 110 with the case 120.

The bracket 110 may include a first component 119 of the attachment mechanism 130 (e.g., one of a clip arm or a tang), and the case 120 may include a second component 129 of the attachment mechanism 130 (e.g., the other of a clip arm or a tang). In certain forms, the case 120 may further include a third component 129' of the attachment mechanism 130, wherein the third component 129' is operable to engage the first component 119. For example, in embodiments in which the first component 119 comprises a clip arm 131 and the second component 129 comprises a tang 135, the third component 129' may comprise a second tang 135'. In certain forms, the tang 135 may be positioned in a groove 126 operable to receive the clip arm 131. The second tang 135' may likewise be positioned in a second groove 126' operable to receive the clip arm 131.

In certain embodiments, the housing assembly 100 may include a guide mechanism configured to guide the attachment mechanism first component 119 into engagement with the attachment mechanism second component 129. For example, the bracket 110 may include one of a ridge 142 or a channel 144 operable to receive the ridge 142, and the case 120 may include the other of the ridge 142 or the channel 144. With the ridge 142 received in the channel 144, the guide mechanism 140 guides the attachment mechanism first component 119 into engagement with the attachment mechanism second component 129. In certain forms, the case 120 may include a second of the other of the ridge 142 or the channel 144 such that the guide mechanism 140 is further operable to guide the attachment mechanism first component 119 into engagement with the attachment mechanism third component 129'. For example, the illustrated guide mechanism 140 includes a second channel 144' operable to receive the ridge 142 to guide the clip arm 131 into engagement with the second tang 135'.

In certain embodiments, such as those in which the case 120 includes an attachment mechanism third component 129' operable to engage the attachment mechanism first component 119, the process 200 may include a selection procedure 220. The selection procedure 220 may include block 222, which generally involves selecting a mounting location based upon a configuration (e.g., handing orientation) of the operator 90. With the operator 90 installed (or to be installed) in the illustrated first handing orientation, block 222 may involve selecting a first mounting location (e.g., the first recess 122). If the operator 90 were instead installed (or to be installed) in a second handing orientation opposite the first handing orientation, block 222 may instead involve selecting a second mounting location (e.g., the second recess 122').

The process 200 may include a bracket mounting procedure 230, which generally involves mounting the bracket 110 to the operator 90. In the illustrated form, the bracket mounting procedure 230 involves block 232, which generally involves attaching the clip portion 116 of the bracket 110 to the tubular portion 93 of the operator body 92 as described above. It should be appreciated, however, that the mounting procedure 230 may instead involve attaching the bracket 110 to the operator 90 in another manner. For example, in embodiments in which the operator 90 lacks a tubular portion 93, the bracket mounting procedure 230 may instead involve mounting the bracket 110 to another portion of the body 92.

The process 200 may include a case mounting procedure 240, which generally involves mounting the case 120 to the bracket 110. In the illustrated form, the case mounting procedure 240 is performed after the bracket mounting procedure 230. In other embodiments, the case mounting procedure 240 may be performed prior to the bracket mounting procedure 230. As will be appreciated, the case mounting procedure 240 may involve mounting the case 120 to the bracket 110 using a selected mounting location, such as the mounting location selected in the selection procedure 220.

The case mounting procedure 240 may include block 242, which generally involves engaging a first portion of a guide mechanism with a second portion of the guide mechanism such that the guide mechanism is operable to guide an attachment mechanism first component into engagement with an attachment mechanism second component. For example, block 242 may involve inserting the ridge 142 into the channel 144 such that the guide mechanism 140 is operable to guide the attachment mechanism first component 119 (e.g. the clip arm 131) into engagement with an attachment mechanism second component 129 (e.g., the tang 135). In such forms, the guide mechanism 140 may limit relative movement of the bracket 110 and the case 120 to movement along a sliding axis (e.g., the sliding axis 102).

The case mounting procedure 240 may include block 244, which generally involves engaging an attachment mechanism first component with an attachment mechanism second component. For example, in the illustrated form, block 244 may involve exerting pushing forces along the sliding axis 102 such that the attachment mechanism first component 119 (e.g. the clip arm 131) engages the attachment mechanism second component 129 (e.g., the tang 135). During block 244, the ramp 136 may cause the clip arm 131 to deflect from its home position to its deflected position until the shoulders 133, 137 clear one another, at which point the resilient clip arm 131 may return to its home position such that the shoulders 133, 137 face one another.

With the case mounting procedure 240 complete, the attachment mechanism 130 selectively prevents pulling forces along the sliding axis 102 (e.g., forces opposite the pushing forces used to engage the attachment mechanism 130) from disengaging the case 120 from the bracket 110. More particularly, should such pulling forces be applied, the abutting shoulders 133, 137 will prevent separation of the case 120 from the bracket 110. In order to separate the case 120 from the bracket 110, the user may perform a knowing act to disengage the engaged components of the attachment mechanism 130. For example, the user may exert a transverse force on the nose 132 of the clip arm 131 to thereby deflect the clip arm 131 to its deflected position. With the clip arm 131 in its deflected position, the clip arm shoulder 133 can clear the tang shoulder 137 to thereby permit separation of the bracket 110 and the case 120.

In certain forms, the process 200 may include a case removal procedure 250, which generally involves removing the case 120 from the bracket 110. The case removal procedure 250 may include block 252, which generally involves performing a known act to permit decoupling of the attachment mechanism 130. For example, block 252 may involve deflecting the clip arm 131 from its home position to its deflected position such that the clip arm shoulder 133 is capable of clearing the tang shoulder 137. In the absence of such a knowing act, separation of the case 120 from the bracket 110 may be prevented. The knowing act may also be such that the pull forces along the sliding axis 102 are greater than a pre-designed force to permit decoupling of the attachment mechanism 130. In such a case, the clip arm shoulder 133 rides over the tang shoulder 137 along the sliding axis 102 in the direction opposite to that discussed in block 244. In the illustrated form, the knowing act can be performed manually and without a tool. In other embodiments, the knowing act may require a tool to complete.

During or after performance of the knowing act in block 252, the case removal procedure 250 may proceed to block 254, which generally involves exerting decoupling forces in a direction opposite the coupling forces that were applied to engage the attachment mechanism components 119, 129 with one another. For example, block 254 may involve exerting a pulling force on the case 120 in the second direction along the sliding axis 102 (downward and rightward in FIG. 2). With separation of the case 120 and bracket 110 permitted (e.g., as a result of the knowing act in block 252), the case 120 may slide off of the bracket 110.

In certain forms, the process 200 may include a bracket removal procedure 260, which generally involves removing the bracket 110 from the operator 90. The bracket removal procedure 260 may include block 262, which generally involves removing the clip portion 116 from the tubular portion 93. In certain forms, block 262 may involve sliding the bracket 110 along the axis 93' and off of the tubular portion 93. It is also contemplated that block 262 may involve deflecting the arm of the clip portion 116 and removing the bracket 110 from the tubular portion 93 in a direction transverse to the axis 93'.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A door operator assembly, comprising:

a door operator;

a bracket configured for mounting to the door operator;

a case configured to at least partially enclose the door operator; and an attachment mechanism comprising a resilient clip configured to selectively secure the case to the bracket in response to a pushing force urging the case and the bracket into engagement with one another; and wherein the attachment mechanism is configured to selectively prevent a pulling force opposite the pushing force from disengaging the case from the bracket.

2. The door operator assembly of claim 1, wherein the attachment mechanism is configured to selectively permit the pulling force to disengage the case from the bracket in response to deformation of the resilient clip.

3. The door operator assembly of claim 1, wherein the attachment mechanism comprises a first component, a second component operable to engage the first component, and a third component operable to engage the first component, and wherein one of the first component or the second component comprises the resilient clip;

wherein the bracket comprises the first component;

wherein the case comprises each of the second component and the third component;

wherein the attachment mechanism is configured to maintain engagement between the bracket and the case when the first component is engaged with the second component; and wherein the attachment mechanism is configured to maintain engagement between the bracket and the case when the first component is engaged with the third component.

4. The door operator assembly of claim 3, wherein the first component comprises the resilient clip;

wherein the second component comprises a first tang; and wherein the third component comprises a second tang.

5. The door operator assembly of claim 3, wherein the bracket comprises a base;

wherein the case comprises a first recess operable to receive the base and a second recess operable to receive the base;

wherein, with the base seated in the first recess, the first component is engaged with the second component, and a pinion of the door operator extends through the second recess; and wherein with the base seated in the second recess, the first component is engaged with the third component, and the pinion extends through the first recess.

6. The door operator assembly of claim 1, further comprising a guide mechanism configured to guide a first component of the attachment mechanism into engagement with a second component of the attachment mechanism.

7. The door operator assembly of claim 1, wherein the resilient clip elastically deforms during engagement of the case with the bracket to selectively secure the case to the bracket.

8. A door operator assembly, comprising:

a door operator;

a bracket configured for mounting to the door operator;

a case configured to at least partially enclose the door operator; and an attachment mechanism configured to selectively secure the case to the bracket in response to a pushing force urging the case and the bracket into engagement with one another;

wherein the attachment mechanism is configured to selectively prevent a pulling force opposite the pushing force from disengaging the case from the bracket;

wherein the attachment mechanism comprises a first component and a second component, wherein the first component comprises one of a clip arm or a tang, and wherein the second component comprises the other of the clip arm or the tang.

9. The door operator assembly of claim 8, wherein the bracket comprises the first component; and wherein the case comprises the second component.

10. A housing assembly for a door operator, the housing assembly comprising:

a bracket configured for mounting to the door operator;

a case configured to at least partially enclose the door operator; and an attachment mechanism configured to selectively couple the bracket with the case, the attachment mechanism comprising:

a resilient clip arm formed on one of the bracket or the case; and a tang formed on the other of the bracket or the case; and wherein the resilient clip arm is configured to engage the tang to maintain engagement between the bracket and the case.

11. The housing assembly of claim 10, wherein the tang is formed within a groove defined by the other of the bracket or the case.

12. The housing assembly of claim 10, wherein the bracket comprises a base;

wherein the case comprises a recess sized and shaped to receive sliding insertion of the base in a first direction; and wherein the resilient clip arm extends in the first direction.

13. The housing assembly of claim 12, wherein the tang comprises a ramp configured to deflect the resilient clip arm from a home position to a deflected position during insertion of the base into the recess.

14. The housing assembly of claim 13, wherein the tang further comprises a first shoulder opposite the ramp;

wherein the resilient clip arm comprises a second shoulder; and wherein the resilient clip arm is configured to return from the deflected position to the home position as the base becomes fully seated in the recess to thereby cause the second shoulder to face the first shoulder.

15. The housing assembly of claim 10, further comprising a guide mechanism configured to guide the resilient clip arm into engagement with the tang.

16. A housing assembly for a door operator, the housing assembly comprising:

an attachment mechanism comprising a first component and a second component operable to engage the first component in response to the first component and the second component being urged toward one another in a first direction;

a bracket configured for mounting to the door operator, the bracket comprising the first component; and a case configured to at least partially enclose the door operator, the case comprising the second component; and wherein one of the first component and the second component comprises a resilient clip that elastically deforms to selectively engage the bracket with the case, and wherein, with the first component and the second component engaged with one another, the attachment mechanism selectively prevents separation of the bracket and the case in a second direction opposite the first direction.

17. The housing assembly of claim 16, wherein the case further comprises a third component of the attachment mechanism;

wherein the third component is operable to engage the first component in response to the first component and the third component being urged toward one another in a third direction; and wherein, with the first component and the third component engaged with one another, the attachment mechanism selectively prevents separation of the bracket and the case in a fourth direction opposite the third direction.

18. The housing assembly of claim 17, wherein the first direction and the third direction are parallel to one another; and wherein the second direction and the fourth direction are parallel to one another.

19. The housing assembly of claim 16, further comprising a guide mechanism configured to guide the first component and the second component into engagement with one another.

20. A housing assembly for a door operator, the housing assembly comprising:

an attachment mechanism comprising a first component and a second component operable to engage the first component in response to the first component and the second component being urged toward one another in a first direction;

a bracket configured for mounting to the door operator, the bracket comprising the first component; and a case configured to at least partially enclose the door operator, the case comprising the second component;

wherein, with the first component and the second component engaged with one another, the attachment mechanism selectively prevents separation of the bracket and the case in a second direction opposite the first direction;

wherein one of the first component or the second component comprises a resilient clip arm, and wherein the other of the first component or the second component comprises a tang.

21. The housing assembly of claim 20, wherein the tang is positioned in a groove configured to receive the resilient clip arm.

* * * * *